US005518557A

United States Patent [19]

Jones et al.

[11] Patent Number: 5,518,557

[45] Date of Patent: May 21, 1996

[54] PROCESS FOR MAKING RAILROAD CAR TRUCK WEAR PLATES

[75] Inventors: Richard L. Jones, Bloomingdale, Ill.; William K. Doyle, Coshocton, Ohio; Gerald L. Farrell, Coshocton, Ohio; Frank R. Hueske, Coshocton, Ohio

[73] Assignee: Standard Car Truck Company, Park Ridge, Ill.

[21] Appl. No.: 190,290

[22] Filed: Feb. 2, 1994

[51] Int. Cl.[6] ..... C21D 8/04

[52] U.S. Cl. ..... 148/511; 148/645; 148/661

[58] Field of Search ..... 148/511, 645, 148/637, 654, 661, 663

[56] References Cited

U.S. PATENT DOCUMENTS 3,668,917 6/1972 Komatsu et al. ..... 148/647

FOREIGN PATENT DOCUMENTS 2671749 7/1992 France ..... 148/647

*Primary Examiner*—Deborah Yee

*Attorney, Agent, or Firm*—Dorn, McEachran, Jambor & Keating

[57] ABSTRACT

A process for making steel wear plates for use as railroad car truck side frame/bolster damping components utilizes the sequential steps of heating, pressing, quenching and then tempering. The heating process includes bringing the wear plate to a temperature of approximately 1750° F. so that the plate is essentially 100 percent austenite. Generally uniform pressure is applied to the plate while heated to bring the plate to a desired flatness. Quenching fluid is thereafter applied to the flattened plate, while maintaining pressure thereon, to bring the plate to a predetermined brinnell hardness, a predetermined temperature, and a metallurgical characteristic of at least 90 percent martensite. The plate is thereafter tempered at a temperature of from 910°–940° F. for a period of time sufficient to bring the plate to a brinnell hardness less than the hardness after quenching.

18 Claims, 5 Drawing Sheets

PROCESS FOR MAKING RAILROAD CAR TRUCK WEAR PLATES

THE FIELD OF THE INVENTION

The present invention relates to a process for the manufacture of wear plates used on the side frame and bolster of railroad car trucks and which form a portion of the damping assembly to control vibration of the truck components during train operation. The process disclosed has substantially wider application and may be used to manufacture other types of wear parts in which the shape of the part and its metallurgical composition after processing must meet certain predetermined specifications.

Wear plates for the use described above are commonly bolted to the side frame column and may be welded into the bolster pocket with such plates being contacted by opposite faces of the friction wedge which is the damping element to control relative movement between the bolster and the side frame. The wear plates protect the softer cast iron of the bolster pocket and the side frame column. The wear plates may be periodically renewed when worn and the use of such plates will materially lengthen the life of the bolster and the side frame, both expensive components of railroad car trucks. To be satisfactory for the described use, the wear plate must have the desired metallurgical composition and must be extremely flat. If the plates are not flat, they will not fit against the cast iron profile of either the side frame column or the bolster pocket, with the end result that the life of the plate and the surface which it protects is shortened and damping of bolster side frame relative movement may be degraded. If the plates do not have the proper metallurgical composition and characteristic the life of the plate will be shortened, requiring an additional expense for the railroad not only in the cost of the plate, but the cost of installation. The particular metallurgical composition is not only required to provide an acceptable wear life for the plate, but also to provide the desired friction between the friction wedge and the column side frame plate which in turn controls the amount of damping which resists side frame bolster relative movement.

It had been prior practice in the manufacture of wear plates of the type described to purchase steel of a desired initial composition and of the correct width for the intended use. The steel was cut off to length to form the plates to size and then the plates were heat treated to bring them to the desired metallurgical characteristic. After heat treatment, the plates were placed within a press and flattened. Unfortunately, the plates did not retain their desired flatness after being subjected to the pressure from the press. This caused the plates to be unacceptable in use, as they did not have the desired flatness to fit properly within the bolster pocket or properly against the side frame column, resulting in the problems described above. The present invention provides a unique process for the manufacture of wear plates in which the pressure to bring the plate to its desired flatness is applied while the plate is in a heated condition and both prior to and during the process for quenching the plate to reduce its temperature from the initial heat treatment. The process disclosed may be used on other types of wear parts, both for railroad use and for use in other environments.

SUMMARY OF THE INVENTION

The present invention relates to a process for the manufacture of steel wear plates for use as damping elements in railroad truck side frame and bolster assemblies.

A primary purpose of the invention is a process of the type described which includes the sequential steps of heating the wear plate, placing the wear plate under pressure to bring it to a desired flatness, quenching the heated wear plate while maintaining pressure upon it, and then tempering the wear plate to bring it to a desired brinnell hardness.

Another purpose of the invention is to provide a process of the type described in which the wear plate retains its desired flatness by being first pressed to the desired configuration immediately after emerging from a furnace, and then quenched, while under pressure, to reduce the temperature of the plate while maintaining the desired flatness.

Another purpose of the invention is to provide a process of the type described in which quenching of the heated wear plate under pressure consists in uniformly reducing the temperature of all parts of the wear plate by circulating a quenching fluid in paths which extend across the wear plate.

Another purpose is a process as described in which the quenching press used to both flatten the plate and to reduce its temperature has a plurality of generally parallel fluid paths, on both sides of the plate, with fluid being simultaneously circulated in all such paths for uniform heat reduction.

Another purpose is a process as described which includes the final step of measuring the flattened wear plate to assure that it has retained the desired degree of flatness.

Another purpose is a process for making steel wear parts which may be pressed to any desired configuration, after heat treatment, which parts will be held in the desired configuration during quenching to maintain the part in the desired configuration while reducing it in temperature and bringing it to a desired metallurgical characteristic.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

The invention will be described in connection with a process for the manufacture of steel wear plates for use in protecting the bolster pocket slanted wall and the side frame column of a railroad car truck. The bolster and the side frame are conventionally formed of cast iron and a spring-biased friction wedge is positioned between these elements to damp relative movement between the bolster and the side frame.

However, there can be substantial wear on the bolster and side frame and for this reason it is common practice in railroad car trucks to use steel plates as wear members for the friction wedge to reduce wear on the cast iron bolster and side frame. The wear plates must be flat so that they fit properly and will stay in place for their intended life. The wear plates must have the correct metallurgy and metallurgical characteristics to provide adequate friction between the friction wedge, bolster and side frame and to provide a plate which will have a useful wear life.

Figure 7:
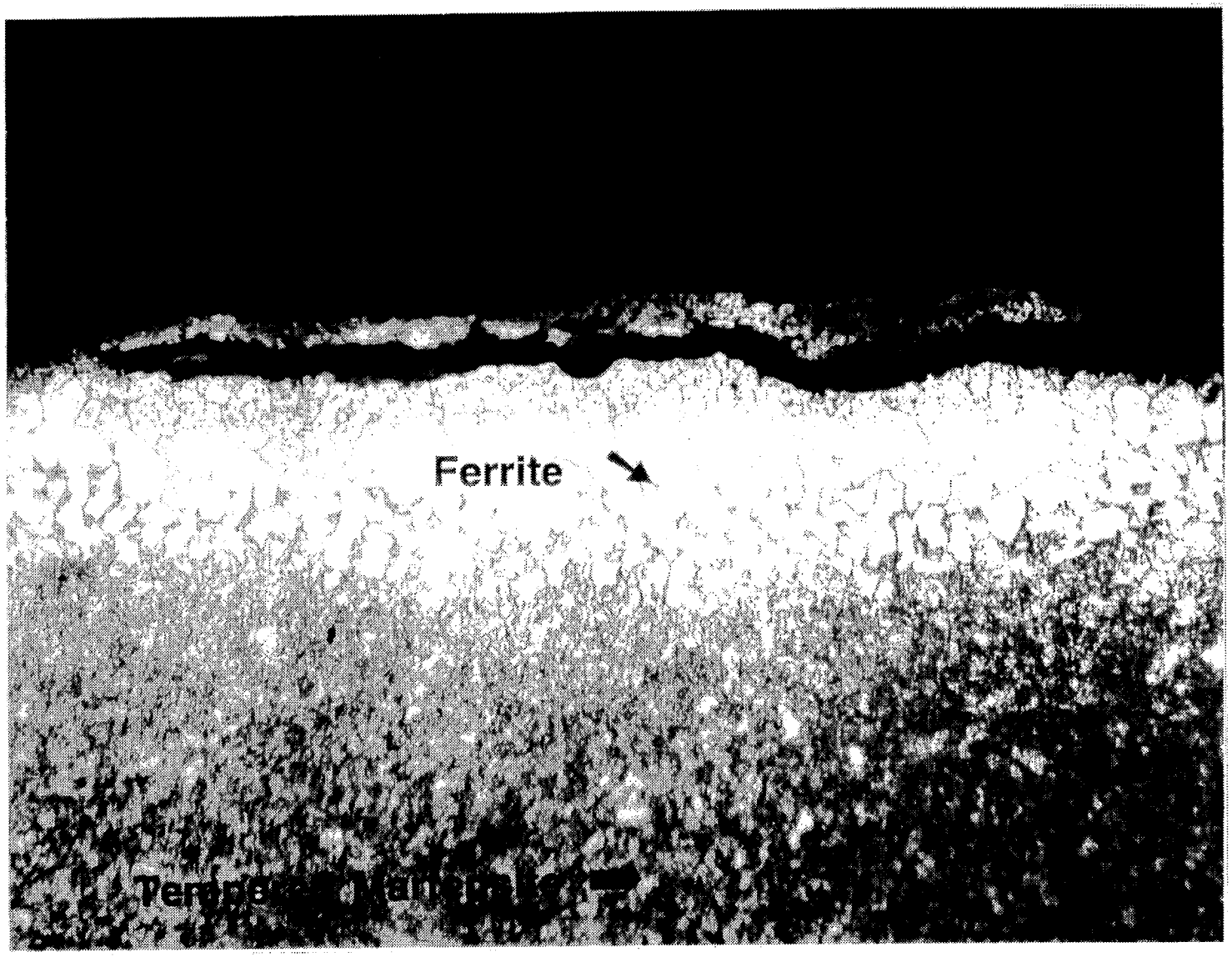
FIG. 7 (PRIOR ART)
FIG. 7 is a photomicrograph of a prior art wear plate.
Figure 8:
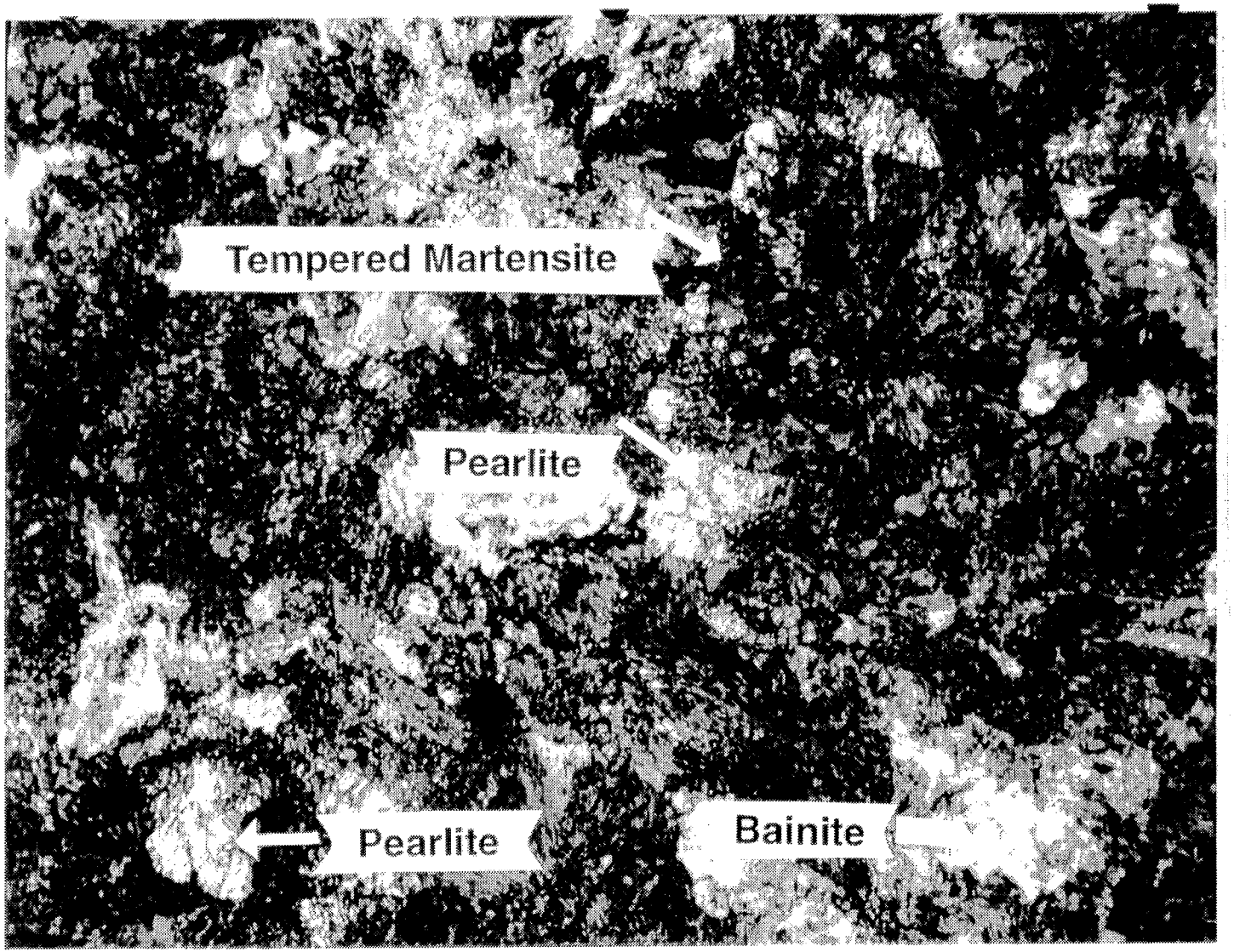
FIG. 8 (PRIOR ART)
FIG. 8 is a photomicrograph of a prior art wear plate.
Figure 9:
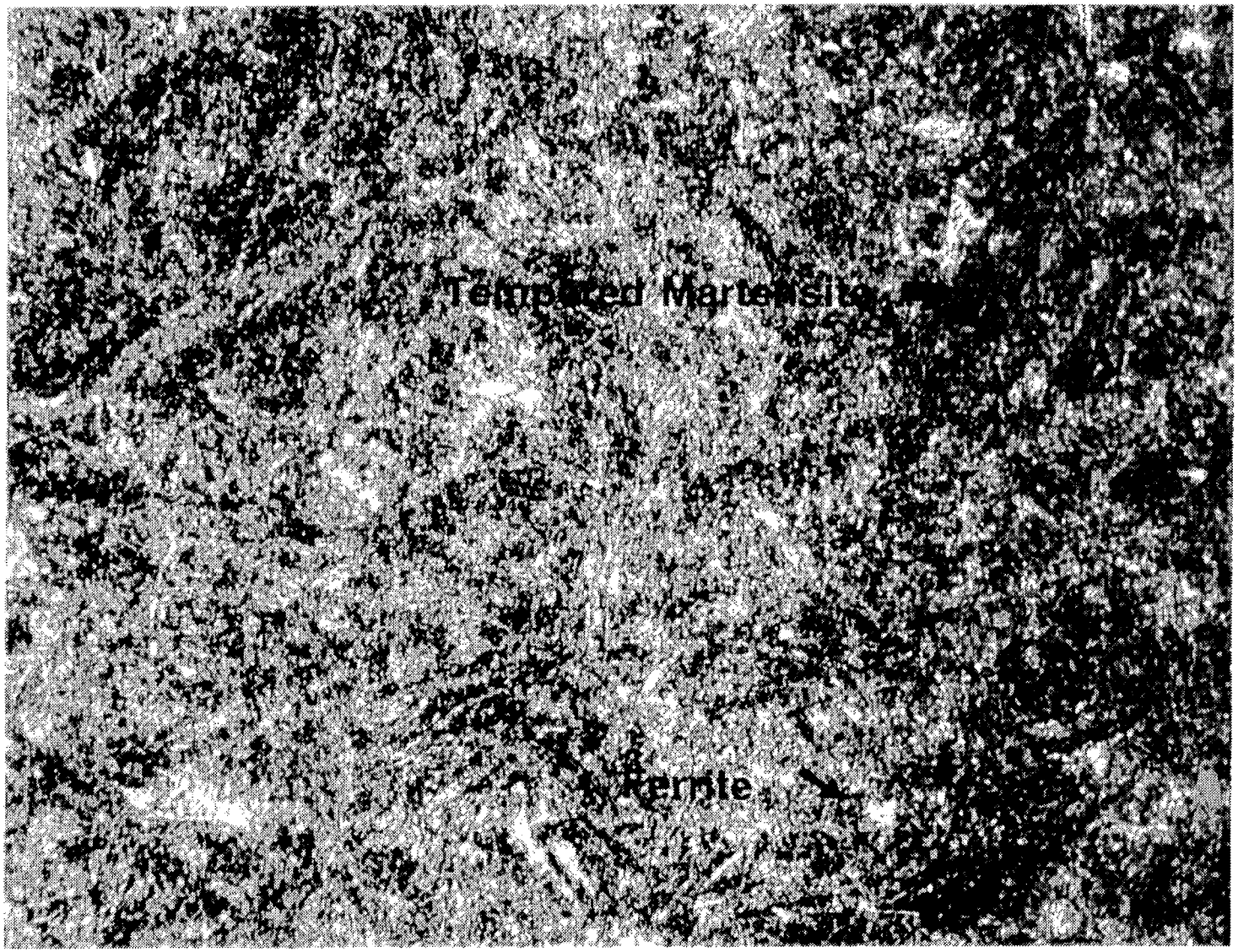
FIG. 9 is a photomicrograph of a wear plate manufactured by the process disclosed herein.

Prior art wear plates which were conventionally made from A.I.S.I. 1095 steel were first sized, then drilled for bolt holes if required, and then heat treated to produce the desired metallurgy. After heat treatment the wear plates were flattened in a press. Unfortunately, in many instances the wear plate did not retain the desired flatness after the application of pressure with the result that the wear plate would loosen in installation, sometimes falling out, or would itself cause wear on either the bolster pocket or the side frame column. Also, the heat treating processes did not always produce the desired metallurgical characteristics to provide the required wear and friction. It is necessary that the wear plate, after the manufacturing process is complete, be at least 90 percent martensite. As illustrated in the photomicrographs of FIGS. 7 and 8, prior art wear plates often had substantial areas of ferrite caused by decarbonization or unacceptable amounts of bainite and pearlite. The present invention provides a wear plate which is at least 90 percent martensite, as illustrated in the photomicrograph of FIG. 9.

Although the invention is described in connection with wear plates for the use intended, it is also applicable to other wear parts, both for railroad use and otherwise. Instead of the wear part being flattened, as described in connection with the wear plate embodiment, the wear part may have a curved profile. The particular profile will be determined by the dies used in the quenching press and the metallurgical characteristics will be determined by the type of steel and the heat treating process. As an example of another railroad wear part which may be formed with the described process, a brake shoe key which is used to hold a brake shoe in place on a railroad car truck, may be formed by the process disclosed herein.

The steel used in the manufacturing process is an A.I.S.I. 1095 steel which has a preferred composition consisting essentially of the following elements, by weight: carbon, 0.94% to 1.0%; manganese, up to 0.60%; phosphorus, up to 0.04%; sulfur, up to 0.05%; balance, iron. At times a grain refining agent such as columbium may be used in the manufacture of this steel.

The steel is received at the manufacturing facility in long sections which have the desired width and the first step in the manufacturing process is to cut the steel into appropriate lengths for use as wear plates. The wear plates may then be cleaned by shot blasting so as to remove any scale which may be residual from the manufacturing process. The plates are then drilled for bolts which are used to hold the wear plates in position on the side frame column. If the wear plates are for a bolster pocket application, no bolt holes need be drilled as the plates will be welded in position.

Once the plates have been cut to length, cleaned by shot blasting and drilled if required, they are placed within a rapid heat furnace in which the plates are heated to a temperature of 1750° F. A furnace manufactured by Fairbanks Braerley of Great Britain is satisfactory for this purpose.

A furnace of the type described has 17 movable stations and the indexing time between stations will vary from 28 to 40 seconds. The elapsed time in the furnace for each plate will be between eight and 11 minutes with the time being largely determined by the succeeding steps in the manufacturing process and by the necessity to insure that each plate is at a temperature of 1750° F. when it leaves the furnace. For this purpose there is a temperature measuring device in the form of a pyrometer at the last station in the furnace, with the pyrometer measuring the temperature of the plate at that location. If the plate is at 1750° F. the plate will be discharged from the furnace. If the plate is not at that temperature movement in the furnace is stopped until the last plate reaches the required temperature. When the plate leaves the furnace, its metallurgical characteristic is 100% austenite.

Figure 1:
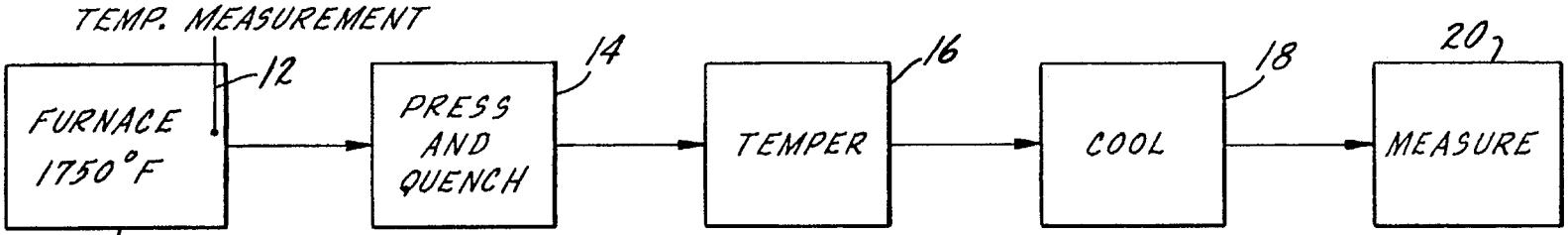
FIG. 1 is a diagrammatic illustration of the manufacturing process disclosed herein.

In the diagrammatic illustration of the process disclosed herein in FIG. 1, the furnace is indicated at 10 and the temperature measuring device is indicated at 12. The plates are removed from the furnace at the designated temperature of 1750° F. and are placed within a quenching press indicated at 14 and disclosed in detail in FIGS. 2–4. Each plate is placed between a pair of quenching dies and a pressure of 10,000 lbs. is applied to the plate to flatten it. This pressure is held for a period of approximately five seconds without the application of any quenching fluid. After the initial flattening of the heated plate, quenching fluid having a temperature of at least 75° F. flows both above and below the pressed plate, while the quenching press maintains the 10,000 lb. pressure applied during the initial flattening step. A preferred quenching fluid contains approximately 22% of a polymer with the balance being water and may be of the type designated as a castrol safety quench two. The total time the plate remains in the quenching press is determined by the thickness of the plate, as when the plate is removed it should be at a temperature of between 220° F. and 290° F. During the time the quenching fluid is circulated past the plate, the temperature is uniformly decreased and there are no residual gas pockets adjacent the plate as there is a continuous flow of liquid past all portions of the plate. As an example of the time a plate remains in the press exposed to the quenching fluid for a plate which is ⅜' thick and has exterior dimensions of 7½"×9⁷⁄₁₆", the quenching time necessary to bring the plate to the desired temperature is approximately 10 to 12 seconds.

When the plate is removed from the quenching press, it has the required flatness. It has a brinnell hardness of from 817 to 850 and its metallurgical characteristic is at least 90% martensite. This is illustrated in the photomicrograph, FIG. 9. This particular metallurgical characteristic is necessary in order to provide the desired wear and friction characteristics for the plate.

After the plates are removed from the quenching press 14, they are placed in a tempering furnace 16 for approximately 75 to 80 minutes and subjected to a temperature of from 910° F. to 940° F. The precise temperature will depend upon the thickness of the plates. Tempering is necessary, as the brinnell hardness of the plates after quenching leaves the plates in a brittle condition and they must be softened so as to be suitable for the intended use. When the plates are removed from the tempering furnace, they will have a brinnell hardness of from 364 to 414. The plates are then placed in a cooling rack, as indicated at 18 in FIG. 1, in which the plates are separated one from another and allowed to either naturally cool or they may be cooled by the application of forced air. What is important is that the plates be allowed to uniformly and slowly cool to room temperature.

Once the plates have been cooled, they again may be shot blasted to remove any scale which may have resulted from the described heat treating process.

Figure 5:
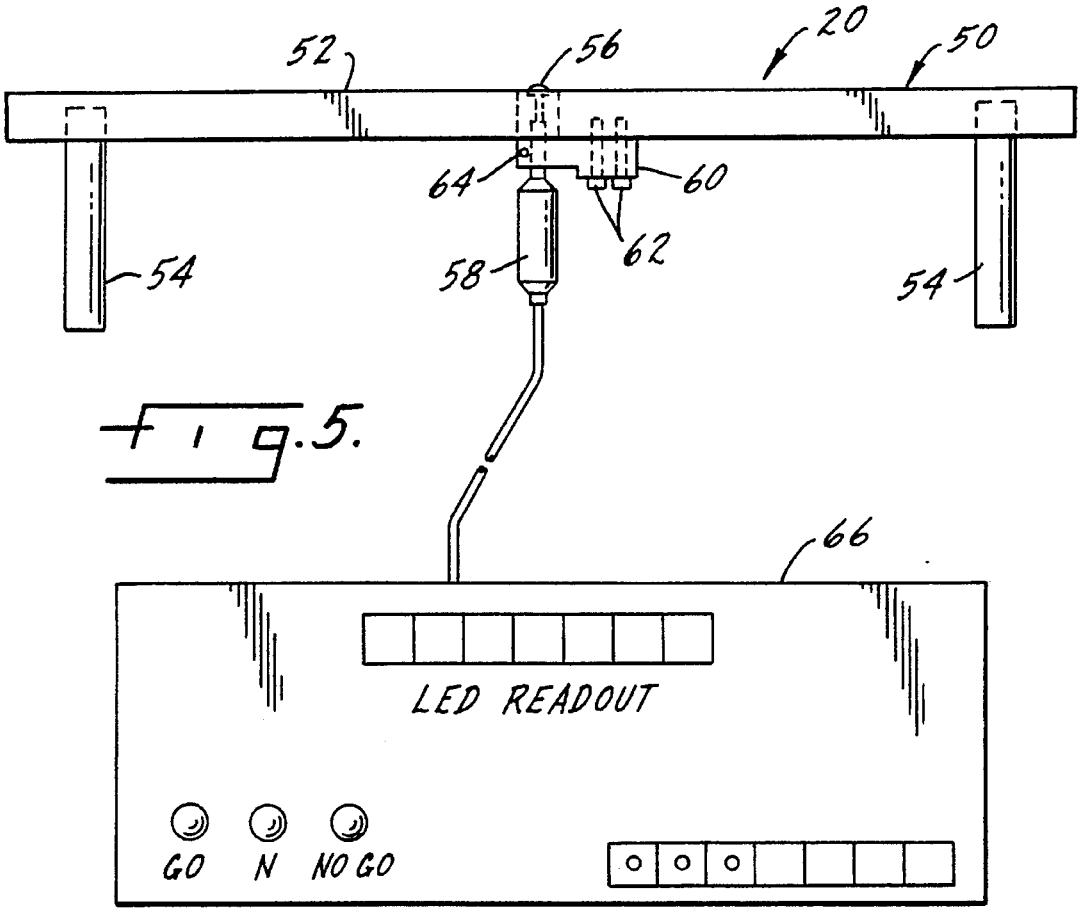
FIG. 5 is a side view of the flatness measurement device of FIG. 1.
Figure 6:
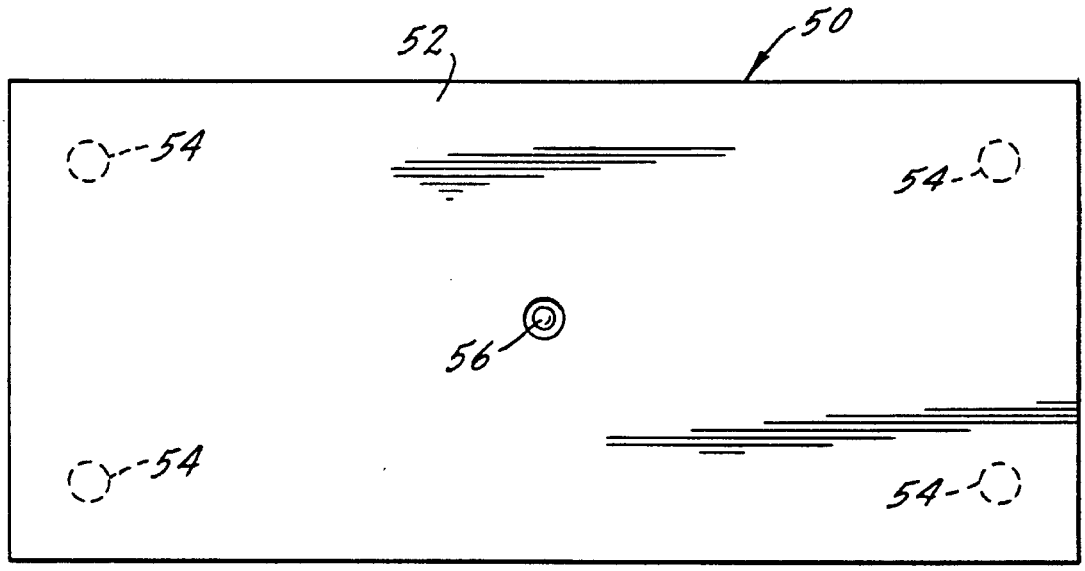
FIG. 6 is a top view of the flatness measurement device of FIG. 5.

The final step in the manufacturing process of the wear plates is to measure the flatness of the plates to insure that they meet the tolerances required for the described use. A measurement device is illustrated in FIGS. 5 and 6. The maximum variation from flatness that is acceptable is 0.020".

Figure 2:
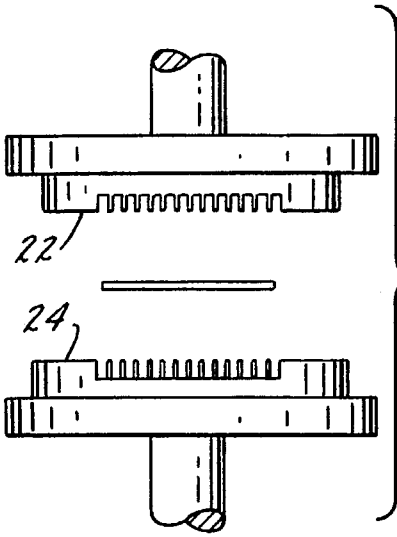
FIG. 2 is a diagrammatic illustration of the quenching press.
Figure 3:
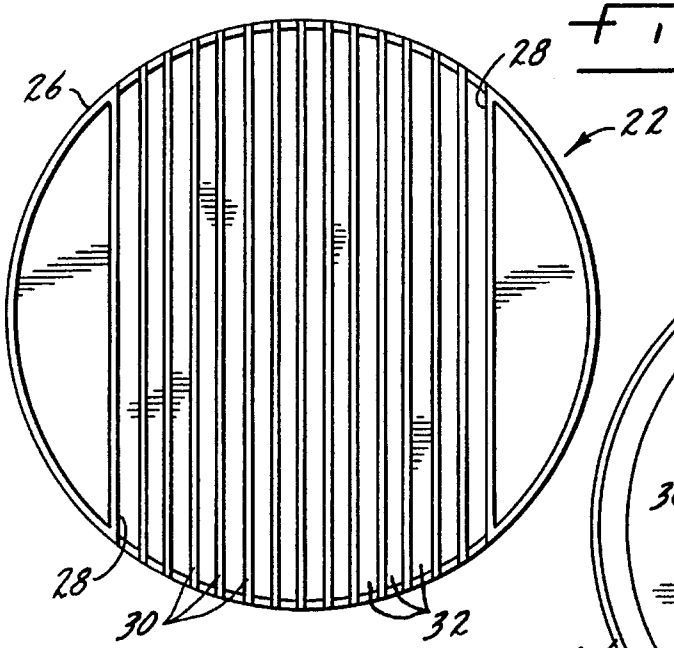
FIG. 3 is a bottom view of the upper die of the press of FIG. 2.
Figure 4:
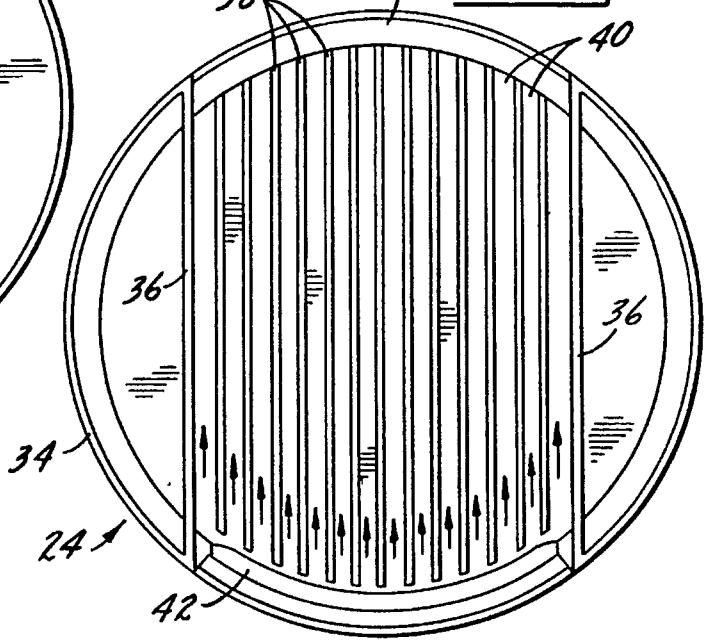
FIG. 4 is a top view of the bottom die of FIG. 2.

The quenching press is illustrated in FIGS. 2 and 3 and includes an upper die 22 and a lower die 24. The upper die has a relatively thick outer rim 26 and a pair of runners 28 which form the outer borders of the flow area for the quenching fluid. The runners for example may have a thickness of approximately ¼". Evenly spaced between the runners are a plurality of runner blades 30, the spacing for which may, for example with a 16 inch die, be 0.72 inch. Between each of the runner blades is a channel 32, with these channels each carrying quenching fluid to thereby move the fluid across the upper surface of the plate as the plate is positioned between the upper and lower dies.

The lower die 24 may similarly have an outer rim 34 and runners 36. There are runner blades 38 which will be in alignment with the runner blades in the upper die and which again will provide a plurality of fluid channels 40 which are used to convey fluid in the direction of the arrows in FIG. 3 past the lower surface of the plate positioned between the dies. There is an inlet manifold 42 in the lower die which will receive fluid from outside of the press housing and which is in communication with both the upper and lower die so as to provide fluid for the channels 40 in the lower die and the channels 32 in the upper die. There is an outlet manifold 44 also in the lower die which will receive the fluid after it has flowed across the plate. Conventionally, the quenching fluid will be filtered, cooled, and then recirculated back through the quenching die so that there is the constant flow of fluid at a controlled temperature across the surface of the plate to uniformly decrease plate temperature in the desired manner. This is important, as unless the plate is quenched in the described manner, it will not have the desired 90% martensite characteristic nor will it retain the required flatness. The plate must be initially pressed in its heated condition as received from the furnace and then quenched and the pressure must be maintained during the quenching period and the quenching must be uniform so that the desired metallurgical characteristic is present. If gas pockets are permitted to form at any area of the plate, the metallurgical characteristic will not be as desired and the unwanted bainite, pearlite or ferrite pockets may form in the plate.

The measurement device illustrated at 20 in the flow diagram of FIG. 1 is illustrated in FIG. 5. There is a table 50 which consists of a flat top cast from ascicular iron of the type described in U.S. Pat. No. 4,166,756. The top 52 is supported on legs 54 and is ground to a flatness of 0.0001"plus 0.0001"–0. Positioned generally centrally within the top 52 is a linear gauge tip 56 having a Rockwell hardness of 48/52. The gauge tip extends outwardly from a linear gauge 58 which may be of a type manufactured by Mitutoyo having a capacitance type of displacement sensor. The gauge 58 may be fastened to the underside of the top 52 by a bracket 60 and cap screws 62. A set screw 64 may be utilized to control the tension of the gauge tip. The gauge tip will extend upwardly above the surface of the plate and will provide, upon contact with the underside of a plate moved over the surface of the top 52, a linear readout from a Mitutoyo SD-D2E digimatic remote display counter indicated at 66. The counter which may be of the go-no go type will linearly indicate the distance between the upper surface of top 52 and the undersurface of the wear plate placed thereon as the wear plate is moved over the measuring device. An out of flatness over 0.020" will not be acceptable and any such reading indicated by the digital counter 66 will indicate an unsatisfactory wear plate.

Of particular importance in the invention is the process by which the wear part, whether it be a wear plate or otherwise, has the desired metallurgical characteristic and the desired shape, whether it be flat or curved, at the end of the quenching and pressing step. The part must first be pressed in its heated condition without quenching for a short period of time after which the part remains in the quenching press for an additional period of time and quenching fluid uniformly flows past the wear part in its pressed shape. The temperature of the part is uniformly reduced to the desired point during which the metallurgical characteristic of the wear part is changed to be at least 90% martensite.

Whereas the preferred form of the invention has been shown and described herein, it should be realized that there may be many modifications, substitutions and alterations thereto.

The embodiments of the invention in which an exclusive property or privilege is claimed are defined as follows:

1. A process for making steel wear plates for use in railroad car trucks including the steps of:

(a) uniformly heating a sized wear plate to a temperature of about 1750° F. resulting in the plate being essentially 100 percent austenite;

(b) applying generally uniform pressure to the plate, while heated, to bring the plate to a desired flatness;

(c) thereafter circulating a quenching fluid directly between the press applying pressure and both sides of the heated plate, while maintaining pressure upon the plate, to rapidly bring the plate to a brinnell hardness of 817 to 850, a metallurgical characteristic of at least 90 percent martensite, and a temperature in the range of 220°–290° F.; and (d) tempering the plate at a temperature between 910°–940° F. for a period of time sufficient to bring the plate to a brinnell hardness less than the hardness after quenching.

2. The process of claim 1 wherein the uniform heating of step (a) is in a furnace with the plates separated one from another.

3. The process of claim 2 wherein the plates are in the furnace for a time period of approximately 8–11 minutes.

4. The process of claim 2 wherein there is the further step of measuring the temperature of each plate adjacent to the exit from the furnace, and if the plate is at a temperature less than 1750° F., holding the plate within the furnace until it has reached the desired temperature.

5. The process of claim 1 wherein the uniform pressure of step (b) is applied for approximately five seconds.

6. The process of claim 1 wherein the uniform pressure of step (b) is approximately 10,000 pounds.

7. The process of claim 1 wherein the pressure applied during quenching is the same pressure as applied during the flattening of step (b).

8. The process of claim 1 wherein the quenching fluid is at least at 75° F.

9. The process of claim 1 wherein the brinnell hardness at the end of the quenching step is from 817 to 850.

10. The process of claim 1 wherein the plates are formed of A.I.S.I. 1095 steel.

11. The process of claim 10 wherein the plate has the composition consisting essentially of, by weight:

C, 0.94% to 1.0%;

Mn, up to 0.60%;

P, up to 0.04%;

S, up to 0.05%;

Balance, iron.

12. The process of claim 1 wherein the tempering temperature is applied for a period of approximately 75 to 80 minutes.

13. The process of claim 1 wherein the brinnell hardness after tempering is from 364 to 414.

14. The process of claim 1 including the subsequent steps of allowing the tempered plates to cool and then subjecting each plate to shot blasting to remove scale therefrom.

15. The process of claim 1 wherein quenching of step (c) takes place in a press having upper and lower dies, each having a plurality of parallel fluid passages.

16. The process of claim 15 wherein the quenching fluid flows simultaneously through each of said parallel fluid passages from an inlet at one end thereof to an outlet at the opposite end thereof.

17. The process of claim 1 wherein there is the further step of measuring the flatness of the plate.

18. The process of claim 17 wherein the measurement of the flatness of the plate is done by a feeler gauge.

* * * * *